US005690031A

United States Patent [19]

Bach et al.

[11] Patent Number: 5,690,031

[45] Date of Patent: Nov. 25, 1997

[54] AERIAL CABLEWAY HAVING A MOVEMENT TAKE UP MODULE

[75] Inventors: Alain Bach, Voreppe; Jean-Pierre Rastello, Grenoble, both of France

[73] Assignee: Pomagalski S. A., France

[21] Appl. No.: 727,043

[22] Filed: Oct. 8, 1996

[30] Foreign Application Priority Data

Oct. 25, 1995 [FR] France ..... 95 12680

[51] Int. Cl.[6] ..... B61B 11/00

[52] U.S. Cl. ..... 104/168; 104/178; 104/180; 104/197

[58] Field of Search ..... 104/163, 168, 104/173.1, 173.2, 178, 179, 180, 189, 190, 197

[56] References Cited

U.S. PATENT DOCUMENTS

| | | | |
|---|---|---|---|
| 4,794,864 | 1/1989 | Feuz et al. | 104/173.2 |
| 4,843,968 | 7/1989 | Rikli | 104/173.1 |
| 4,942,823 | 7/1990 | Meindl | 104/178 |
| 5,105,745 | 4/1992 | Tarassoff | 104/178 |
| 5,159,880 | 11/1992 | Mungnier | 104/168 |
| 5,515,789 | 5/1996 | Brochand et al. | 104/178 |

FOREIGN PATENT DOCUMENTS

| | | |
|---|---|---|
| 0355084 | 2/1990 | European Pat. Off. . |
| 0486405 | 5/1992 | European Pat. Off. . |

*Primary Examiner*—S. Joseph Morano
*Attorney, Agent, or Firm*—Parkhurst, Wendel & Burr, L.L.P.

[57] ABSTRACT

The chairs or the cabins of an overhead cable transport installation are driven on a transfer rail in a station by means of friction sheaves staggered along the travel circuit and interconnected by a belt drive arrangement. The rotational movement of the friction sheaves is derived from a cable support sheave by means of a movement take up module, having a girder like box secured adjacent to the girder which supports the friction sheaves. This module has a belt pulley interconnected to a belt pulley of the cable support sheave and a cog-wheel transmission between this belt pulley and the friction sheave,

6 Claims, 4 Drawing Sheets

10
10'
26'
27'
19'
10
23
26
27
28
19
16
25'
32
24
25
29
21
16
16

AERIAL CABLEWAY HAVING A MOVEMENT TAKE UP MODULE

BACKGROUND OF THE INVENTION

The present invention relates to an overhead cable transport installation, such as a gondola lift or a chairlift, having a device for driving cars or chairs in stations or terminals. The aerial cable runs continuously in a closed circuit and the cars or chairs are detached from the cable as they enter the station and travel through the station on a half-loop circuit linking the up and down tracks before being reattached to the cable as they leave the station. As used herein the expressions chairlifts and chairs shall respectivelly include gondola-lifts and cars or gondolas and similar apparatuses. The chairs are fixed by a hanger arm to a carriage bearing a grip for coupling it to the cable and having rollers for running on a transfer rail extending in a half-loop circuit in the stations. The grip is of the detachable type permitting the uncoupling of the carriage from the cable in the stations and the running on a transfer guiding rail at a slow speed. The braking or deceleration, the acceleration and the driving of the uncoupled grip carriage in the stations is provided by wheels or sheaves frictionally acting on a running friction plate rigidly secured to the grip carriage body. The friction drive sheaves, for instance pneumatic wheels, are staggered along the travel circuit in the station to cooperate with the friction plate so as to propel the chairs along the transfer rail. The successive friction sheaves are drivingly interconnected by belt drive means having belt pulleys mounted on the spindles of the friction sheaves. The belt pulleys located along the deceleration sections and the acceleration sections have different diameters, so that the rotational speeds of the friction sheaves decrease or increase, to decelerate or accelerate the chairs running on the transfer rail. The rotational movement of the friction sheaves is derived directly from the aerial cable, so that the speed of rotation of the friction sheaves is synchronized to that of the aerial cable. A chair lift or gondola lift of the aforementioned type has been disclosed in U.S. Pat. N. 5,159,880.

The movement derivation takes place, preferably, on a cable supporting sheave having a spindle with a belt pulley mounted thereon. This belt pulley is interconnected by a belt to a belt pulley of a friction sheave, so as to drive a set of friction sheaves. This direct movement take up device on the aerial cable has a simplicity and flexibility of operation which is remarkable and is particularly adapted for continuous operation.

The friction sheaves are located above the friction plate and it is easy to see that the friction sheaves must turn in a direction opposite to that of the cable supporting sheave, to drive the chairs in the direction of movement of the aerial cable. Belt transmissions, more particularly V-belts, are not well suited for changing the sense of rotation and the conventional transmission devices result in structure which is complicated and costly.

SUMMARY OF THE INVENTION

The object of the present invention is to provide a movement take up device on an aerial cable, which is particularly simple and which presents a modular structure.

According to the invention the movement take up device is devised as a module associated to a friction sheave and this module comprises a belt pulley and a cog-wheel transmission between the belt pulley and the friction sheave providing an inversion of the rotation. The belt pulley of this module is interconnected to the belt pulley of the cable supporting sheave by a conventional V-belt.

The movement take up module is, advantageously, mounted in a girder section box having a length which corresponds to the spacing between two neighboring friction sheaves. Such a girder box may be inserted in the girder, or constitute a section of the girder, which extends substantially parallel to the transfer rail and supports the spindles of the successive friction sheaves. The regular spacing of the friction sheaves is not modified and several girder boxes may be located adjacent or spaced along the girder, The girder box is located above the cable supporting sheave and is drivingly interconnected thereon by a vertical belt. The belt pulleys and the belts are disposed on one side of the girder and the friction sheaves on the other side.

BRIEF DESCRIPTION OF THE DRAWINGS

The invention will be further described, by way of example, with reference to the accompanying drawings, in which.

DESCRIPTION OF PREFERRED EMBODIMENT

Figure 1:
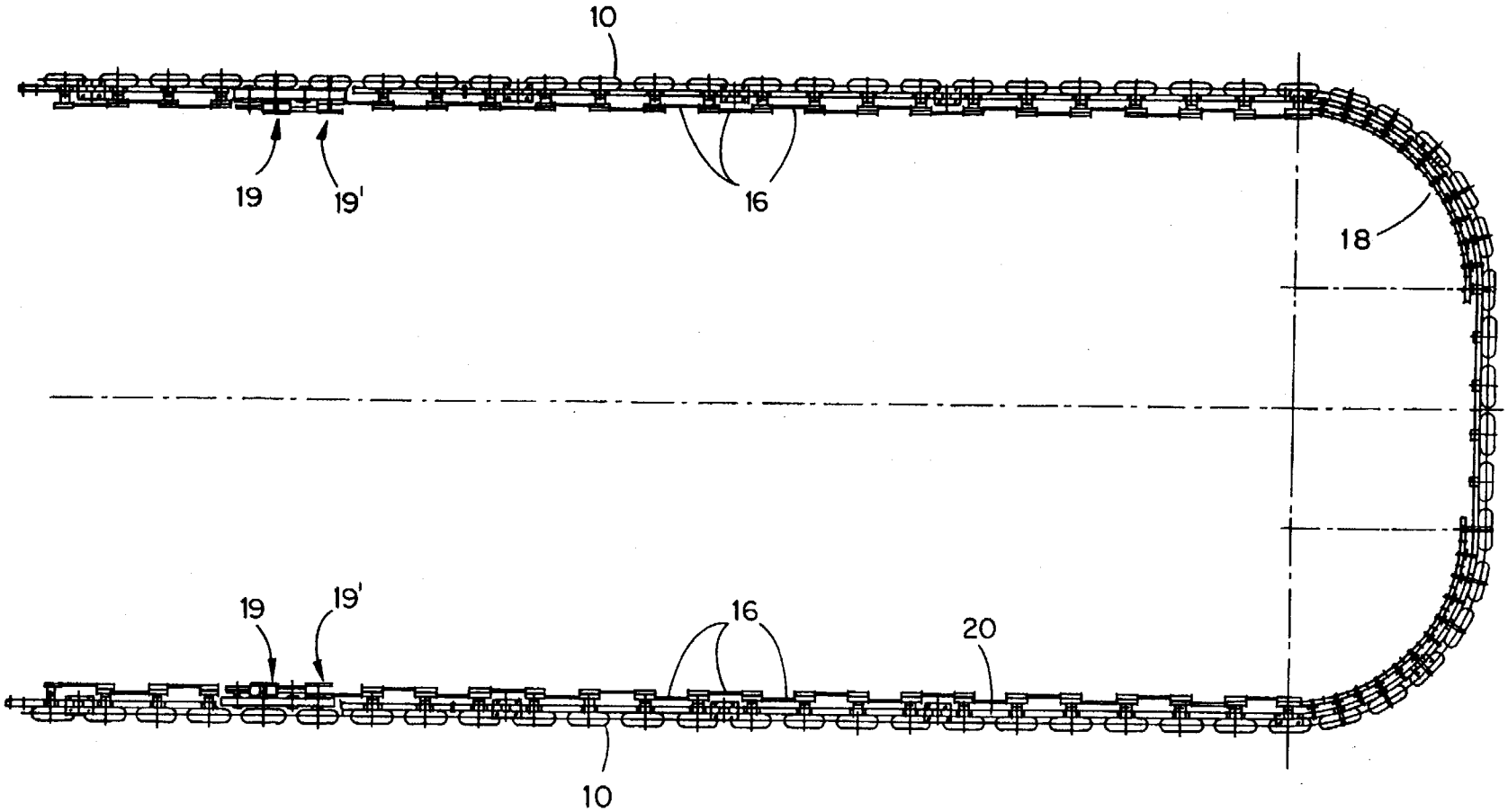
FIG. 1 is a schematic plan view of an installation in accordance with the invention.

In FIG. 1, an overhead cable transport installation, for example, a single cable detachable gondola lift or chairlift, comprises a hauling-carrier cable 12, extending in a closed loop between two uphill and downhill stations. The cable 12 is supported by sheaves 17 and in operation it turns these sheaves 17 at a speed which corresponds to the speed of the cable 12. The loads, particularly gondolas or chairs, hereafter named chairs, are coupled on the line to the cable 12 by grips 13 having rollers 14. At the entry to the station, a half loop transfer rail 11, on which the rollers 14 engage, is disposed parallel to the cable 12 and a ramp opens the grip 13 to uncouple it from the cable 12. The grip 13 comprises a drive plate 15, which cooperates with friction drive sheaves 10 regularly staggered along the transfer rail 11 to drive the chair in the station. The friction sheaves 10 decelerate the grip detached from the cable 12, drive the grip on the rail 11 and accelerate it, for coupling to the cable 12, at the station exit.

Each friction shears 10 is supported by a spindle 23, rotatably mounted on a girder 20 which extends along the transfer rail 11. Transmission of the movement from one friction sheave 10 to the next is by means of belts 16 and pulleys. At the station entrance the diameter of the belt pulleys are variable so that the friction sheaves which follow one another possess successively decreasing rotational speeds for braking the chairs and in the same manner the chairs are accelerated at the station exit. In the station the friction sheaves 10 rotate preferably at the same speed and in the curved section 18 of the transfer rail 11 a cog-wheel transmission system is advantageously used in place of the belt system. Detachable chairlifts of this kind are well-known and for example described in the aforementioned U.S. Pat. No. 5,159,880.

Figure 2:
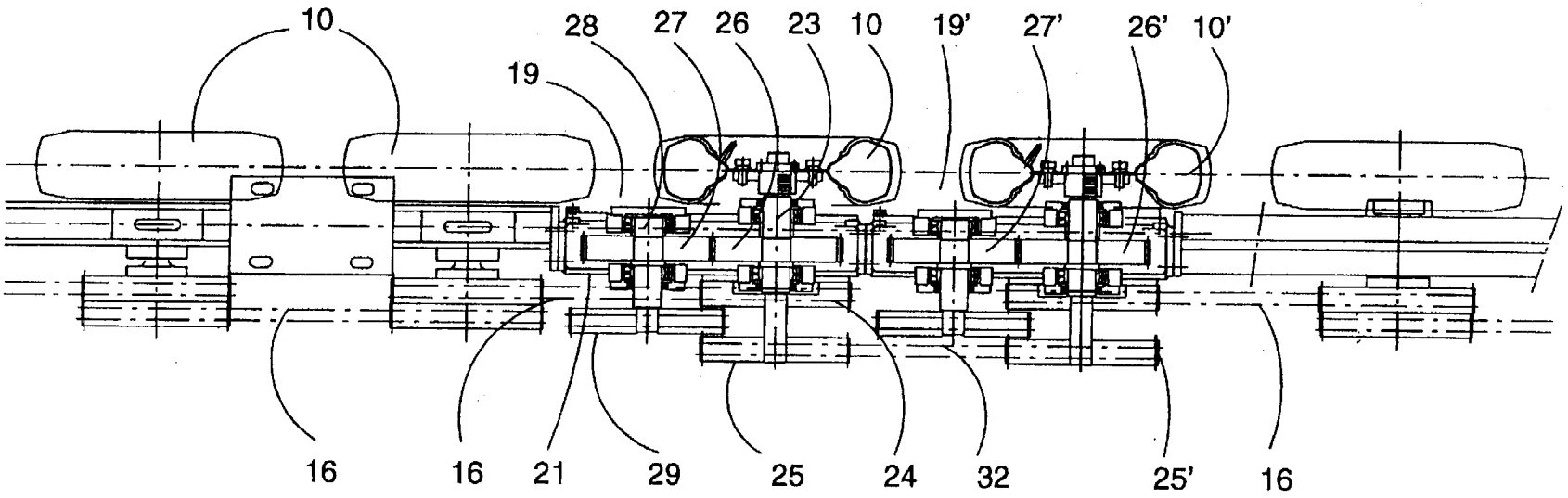
FIG. 2 is an enlarged view of a section of the installation of FIG. 1, showing movement take up modules.
Figure 3:
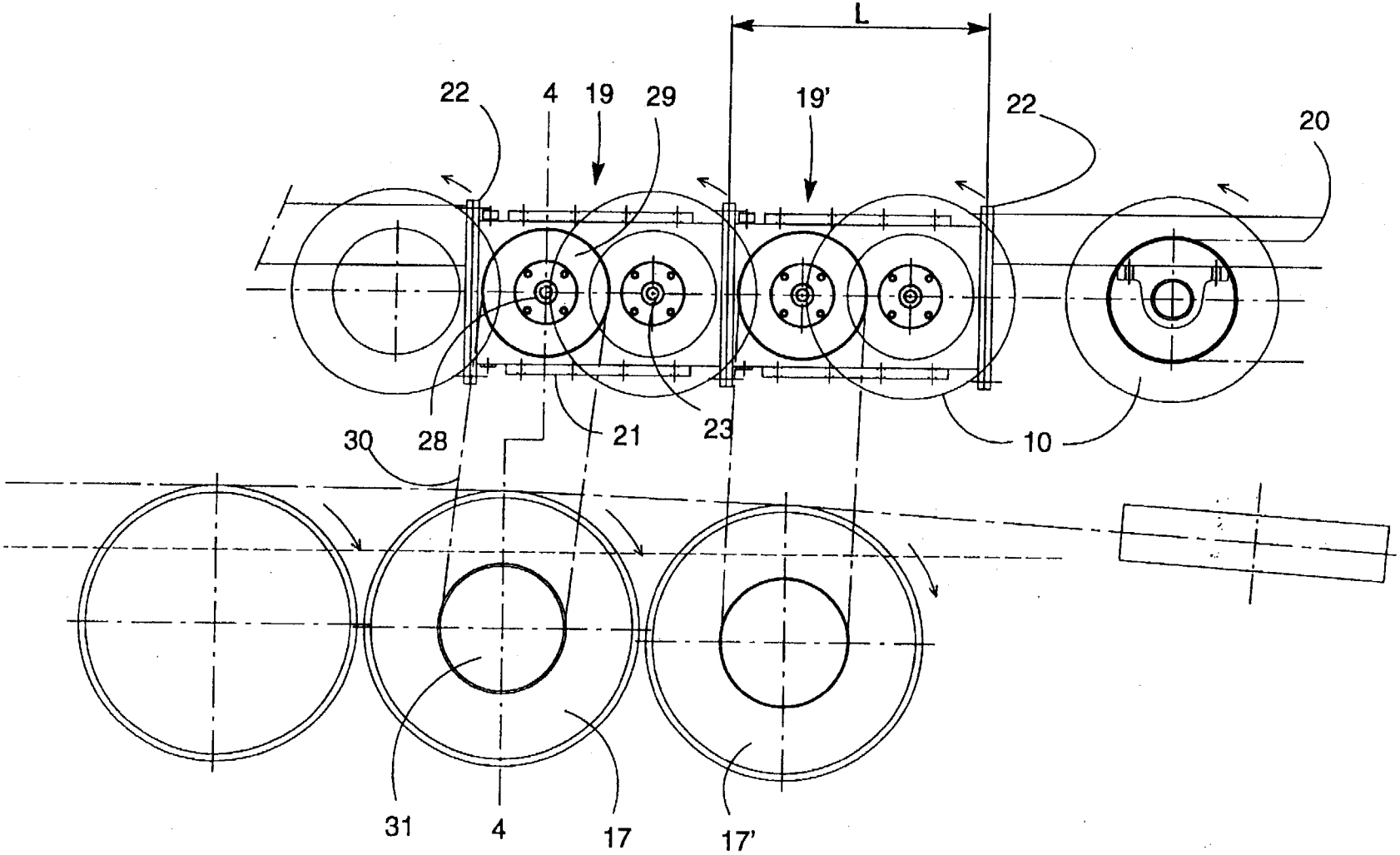
FIG. 3 is a elevational view of the movement take up modules shown in FIG. 2.
Figure 4:
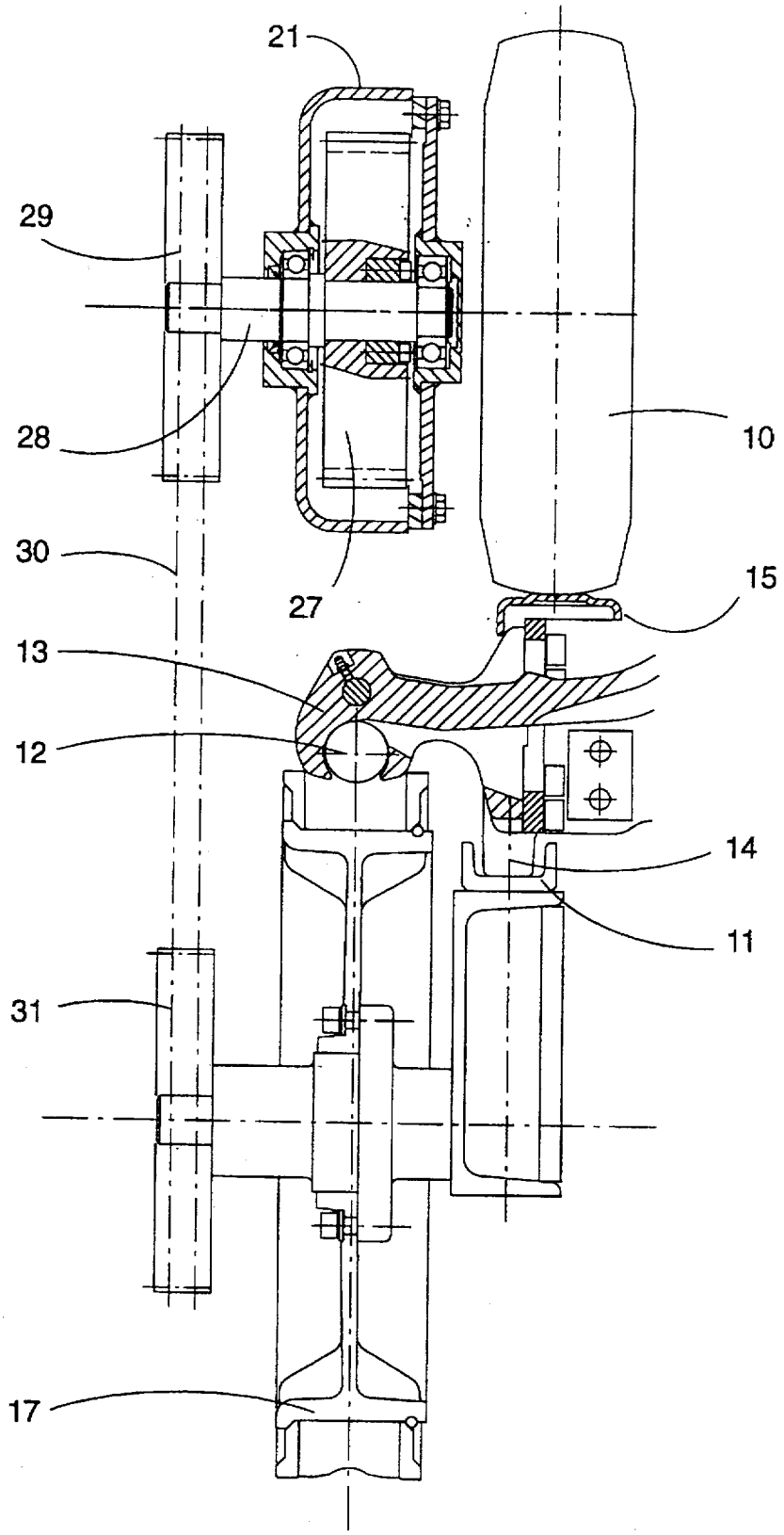
FIG. 4 is a cross section taken along line 4—4 of FIG. 3.

As best may be seen in FIG. 2-4 two movement take up modules 19 are inserted, one after the other, between two sections of girder 20. The two sections of modules 19 are identical and only one of these modules will be described hereinafter, the other module having the same reference numbers with a accent. The movement take up module 19 comprises a box like girder section 21, having a length 2 corresponding to the spacing of the friction sheaves 10. The girder box 21 is rigidly secured by means of fastening members 22 to the adjacent girder 20 sections. A first transverse spindle 23 is rotatably mounted in the girder box 21 and a friction sheave 10 is wedged onto one end of that first spindle 23, projecting laterally on one side of the box girder 21. Onto the opposite end of the first spindle 23, which projects on the other side of the girder box 21, are wedged a first belt pulley 24 and a second belt pulley 25. A toothed pinion 26, wedged onto the first spindle 23, is located inside the girder box 21 and this toothed pinion 26 engages with another toothed pinion 27, wedged onto a second transverse spindle 28 rotatably mounted on the girder box 21. The second spindle 28 extends in the same plane, parallel to the first spindle 23, and presents one end which projects from the girder box 21, on the side opposite to the friction sheave 10, and supports a drive pulley 29, connected by a belt 30 to a pulley 31, wedged onto the spindle of the cable support sheave 17. As will be readily observed by inspecting FIG. 3, the support sheave 17, driven by the cable 12, rotates in a clock-wise direction shown by an arrow and it drives by means of the belt 30 and the toothed pinions 26,27, the friction sheave 10 in the opposite rotational direction so as to propel the chair correctly in the direction of advancement of the cable 12. A simple belt 30 transmits movement to the module 19 and the toothed pinions 26,27 provide the inversion of the rotation direction. The friction sheave 10 of the module 19 is coupled to the adjacent friction sheave 10, on the left side on FIG. 2, in the usual manner, by a drive belt 16, which cooperates with the first belt pulley 24 of the first spindle 23. Module 19 drives the set of friction sheaves 10 on its left side on FIG. 3 and it is clear that this module 19 could drive, in the same manner, the friction sheaves 10 on the right side, for instance by means of a belt transmission cooperating with the second pulley 25.

According to an aspect of the present invention, shown in the Figure, a second module 19' is operatively associated with the friction sheave 10 drive system. This second module 19', adjacent to the first module 19, cooperates with a second cable support sheave 17' and it drives the set of friction sheaves 10 located on its right side. Operation of this second module is the same of that of the first and it is clear that a greater number of modules may be used. The two modules 19,19' are advantageously operatively connected by a belt 32 which cooperates with the second pulleys 25,25', so as to provide a security drive means and to impose a perfect synchronisation. The diameters of the toothed pinions 26,27 may be different so as to reduce or to increase the rotational speed, to adapt the movement take up device to different installations. It is clear that the two modules 19,19' may be included into a single girder box having a greater length. The module 19 is advantageously located in the vertical plane of the cable support sheave 17 so as to reduce the length of the belt 30.

What is claimed is:

1. An overhead cable transport installation comprising:

a continuous aerial cable, a load supporting detachable grip adapted to be coupled to and decoupled from said cable at a station, a transfer rail provided at the station, a girder extending along the transfer rail, friction sheaves successively arranged along the transfer rail and having spindles rotatably mounted on said girder, a drive plate rigidly secured to said grip and cooperating with said friction sheaves to propel the grip along the transfer rail, belt drive means having belts and pulleys amounted on the friction sheave spindles for drivingly interconnecting the successive friction sheaves, a cable support sheave for supporting said cable and having a spindle with a belt pulley mounted thereon, a movement take up module comprising one of said friction sheaves, a drive pulley drivingly connected to said belt pulley of the cable support sheave, and a cog-wheel transmission between said drive pulley and said one friction sheave to invert the direction of rotation of said friction sheave with respect to the drive pulley, said drive pulley and said cog-wheel transmission being supported by said girder.

2. The installation of claim 1, wherein the girder, includes first and second girder section boxes each having a length corresponding to the spacing of the friction sheaves.

3. The installation of claim 2, wherein said cog-wheel transmission comprises a toothed pinion secured on the spindle of said one friction sheave, and a toothed pinion secured on the spindle of said drive pulley, said spindles being rotatably mounted on said first girder section box.

4. The installation of claim 3, wherein said toothed pinions are located inside the first girder section box, said friction sheaves being disposed on one side of said girder and said belt pulleys being disposed on the other side of said girder.

5. The installation of claim 1, further comprising (i) another movement take up module adjacent to the first module, each module cooperating with one cable support sheave for driving one set of interconnected friction sheaves, and (ii) a belt transmission between said two modules.

6. The installation of claim 1, wherein the spindle of the cable support sheave is substantially disposed in the vertical plane of and under the spindle of the drive pulley.

* * * * *